United States Patent [19]

Wolfe

[11] Patent Number: 4,588,618

[45] Date of Patent: May 13, 1986

[54] ORNAMENTAL FLOATING APPARATUS

[75] Inventor: Henry S. Wolfe, St. Petersburg, Fla.

[73] Assignee: Gulf Coast Aqua Leisure, Inc., Clearwater, Fla.

[21] Appl. No.: 652,622

[22] Filed: Sep. 18, 1984

[51] Int. Cl.[4] ..... A41G 1/00; G09F 19/02

[52] U.S. Cl. ..... 428/7; 119/5; 428/24; 431/125; 446/153

[58] Field of Search ..... 40/617; 428/7, 15, 16, 428/24; 431/125, 126; 446/153, 159; 119/5

[56] References Cited

U.S. PATENT DOCUMENTS

| | | | |
|---|---|---|---|
| 1,730,628 | 3/1927 | Rogers | 428/26 |
| 2,234,903 | 3/1941 | Muench | 431/125 |
| 2,330,705 | 9/1943 | Hamblet | 431/125 |
| 2,339,983 | 1/1944 | Day | 446/153 X |
| 2,464,859 | 4/1947 | Gilowitz | 428/24 X |
| 2,714,652 | 8/1955 | Meyer | 428/16 X |
| 2,974,509 | 3/1961 | Penke | 431/125 |
| 3,039,220 | 6/1962 | Fristot | D11/117 |
| 3,050,619 | 10/1959 | Abramson | 428/24 X |
| 3,088,295 | 5/1963 | Haines | 63/20 |
| 3,137,610 | 5/1961 | Flynn | 428/24 X |
| 3,204,277 | 9/1961 | Visman et al. | 428/24 X |
| 3,265,388 | 8/1966 | Kane, III | 446/159 X |
| 3,271,897 | 9/1966 | Gelinas | 446/153 |
| 3,327,686 | 6/1967 | Holden | 119/3 |
| 3,434,789 | 3/1969 | Haller | 431/126 |
| 3,517,649 | 6/1970 | Holden | 119/5 |
| 3,574,901 | 4/1971 | Nogue | 428/24 X |
| 3,762,084 | 10/1973 | Jones | 428/16 X |
| 4,110,066 | 8/1978 | Murphy | 431/125 X |
| 4,490,931 | 1/1985 | Fleemin | 40/440 X |

FOREIGN PATENT DOCUMENTS

| | | | |
|---|---|---|---|
| 457013 | 5/1949 | Canada | 446/153 |
| 717804 | 11/1954 | United Kingdom | 428/16 |

*Primary Examiner*—Henry F. Epstein
*Attorney, Agent, or Firm*—Irvin A. Lavine

[57] ABSTRACT

An ornamental floating apparatus for use in a swimming pool comprises a first buoyant body, preferably in the form of a water lily, and a second, nonbuoyant body, which is below the first body and supported by it so that it is stable, moving about a horizontal axis when the first body moves about a horizontal axis, as due to agitation of the water in the swimming pool. The second body may be connected either by a substantially rigid post, or by a pair of flexible strands, preferably monofilament. The second bodies are in the form of fishes, relatively large fishes being supported by the flexible strands, and relatively smaller fishes being supported by the posts. The ornamental body is preferably in the form of a water lily, and has a plurality of petal-simulating elements thereon, with a cup in the center of the elements for supporting a candle, the cup having a stem extending through holes in the elements and into the body.

20 Claims, 3 Drawing Figures

ORNAMENTAL FLOATING APPARATUS

TECHNICAL FIELD

The present invention relates to a floating ornament apparatus for use in swimming pools.

BACKGROUND ART

There have been made various suggestions for providing ornamental devices for bodies of water, such as swimming pools and aquariums. Gelinas U.S. Pat. No. 3,271,897 provides an aquatic ornament including a floating sphere having a ring, to which is attached a transparent line, the line supporting a submerged body simulating a goldfish. Holden U.S. Pat. No. 3,327,686 and Holden U.S. Pat. No. 3,517,649 provide floating scenery-simulating structures for use on the surface of an aquarium, there being no submerged body.

It is known, also, to provide floating bodies which support candles. Muench U.S. Pat. No. 2,234,903 discloses a floating candle which is made entirely of wax. Hamblet U.S. Pat. No. 2,330,705 provides a candle base in the form of a flower, with a recess in which is positioned a candle. Haller U.S. Pat. No. 3,434,789, includes a buoyant member in the form of a star, and having a hole in the central part, in which a candle is positioned. Murphy U.S. Pat. No. 4,110,066 shows an anular floating element within which is a candle wick, the element floating on a pool of oil within a drinking glass.

Artificial flowers have been constructed, there typically being provided a plurality of superimposed petal-simulating elements having a central hole passing through them, and a pin or post-like member extending through the holes, and secured, so as to hold the petals in assembled relationship. Examples of such construction are Fristot U.S. Pat. No. 3,039,220 and Haines U.S. Pat. No. 3,088,295.

DISCLOSURE OF INVENTION

The present invention is directed to an ornamental floating apparatus, particularly for use in swimming pools. There is provided a first buoyant body, which is preferably in the form of a water lily pad. This buoyant body is provided with rings, and, on its undersurface and upper surface, with sockets. Relatively small bodies, in the form of fish, such as goldfish, are supported beneath the body by substantially rigid posts extending upwardly from the goldfish, and into sockets in the bottom of the buoyant body. In addition, one or more relatively large non-buoyant bodies is supported beneath the buoyant body by at least two flexible strands or lines, having their upper ends engaged in spaced rings on the first body, and connected to the large non-buoyant bodies at spaced portions. In this way, both the large and small non-buoyant bodies are stable, and are capable of moving about a horizontal axis with movement of the first buoyant body about a horizontal axis. The movement of the first body will have been caused by agitation of the water.

The floating apparatus simulates a flower, particularly a water lily, by the provision of a plurality of superimposed petal-simulating elements, having centrally positioned aligned openings. The body is provided on its upper surface with a socket, and a cup for holding a candle is provided centrally in the petal-simulating elements, the cup having a stem or post extending downwardly through the openings or holes in these elements, and into the socket in the upper surface of the buoyant body, thereby releasably securing the petal-simulating elements in assembled relationship with the buoyant body. Additionally, a simulation of an animal, specifically a frog, is provided on the body, having a post extending into a socket into the upper surface of the body.

Among the objects of the present invention are the provision of an ornamental floating apparatus which will be economical to manufacture, pleasing in appearance, and which will provide a fist body simulating a floral object, such as a water lily, and supporting from such buoyant body one or more additional bodies simulating fish, said supported bodies being supported in a relatively stable manner so that they move harmoniously with movement of the first body. Another object is to provide an ornamental floating apparatus permitting ready replacement of petal-simulating elements, the securing of a greater or lesser number of fish-simulating non-buoyant bodies, as well as provision of a floating ornament in which a cup for holding a candle serves as a part of a securing apparatus for petal-simulating elements.

Other objects and many of the attendant advantages of the present invention will be readily understood from a consideration of the following drawings, description and claims.

BEST MODE OF CARRYING OUT THE INVENTION

Figure 1:
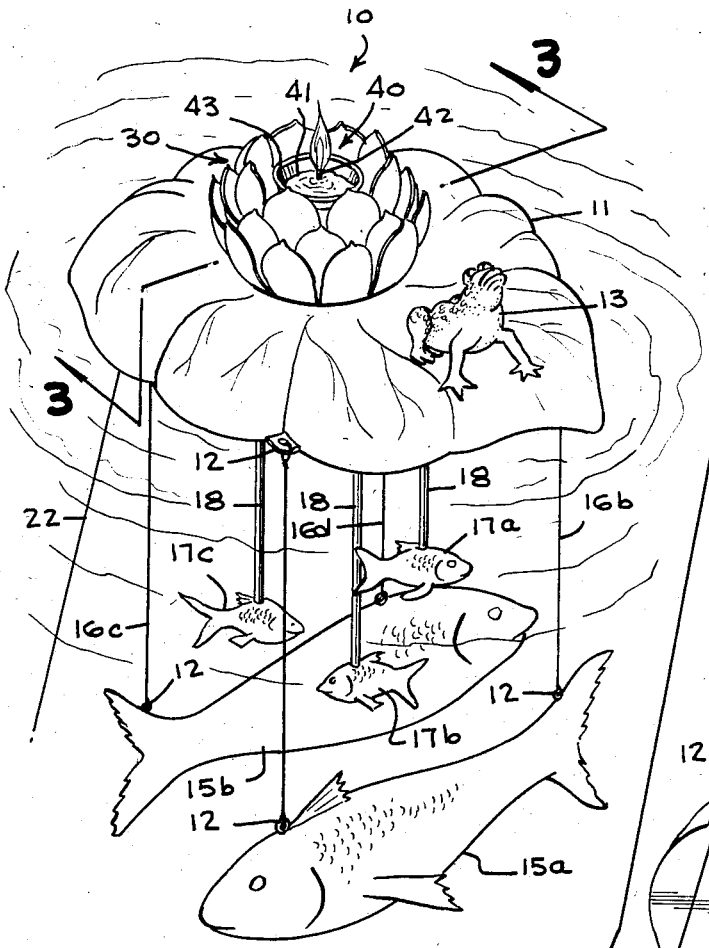
FIG. 1 is a perspective view of an ornamental floating apparatus in accordance with the present invention.
Figure 2:
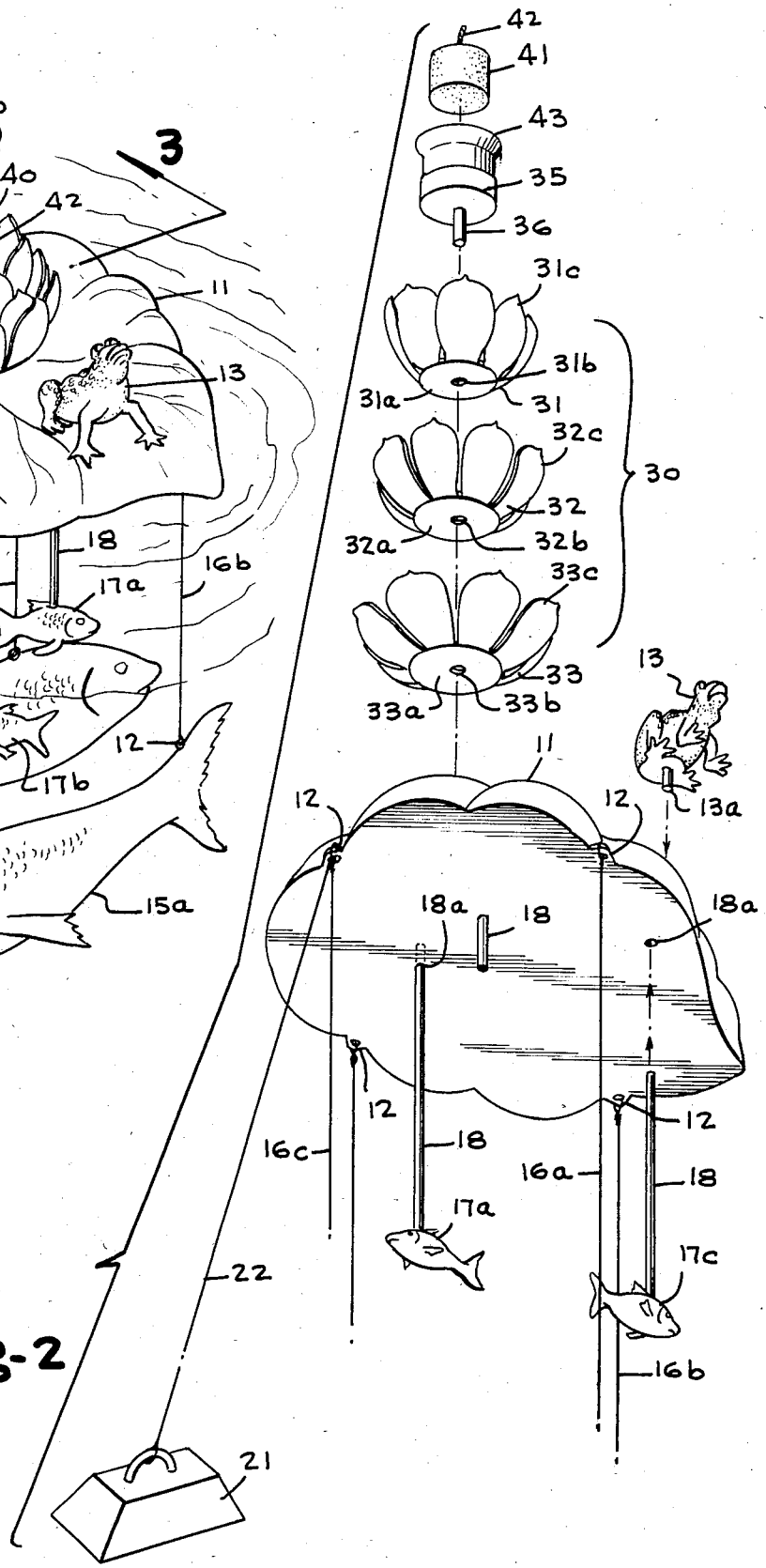
FIG. 2 is an exploded perspective view of the apparatus as shown in FIG. 1 with parts removed.

Referring now to the drawings, wherein like or corresponding reference numerals are used for like or corresponding parts throughout the several views, there is shown in FIG. 1 an ornamental floating apparatus for swimming pools and the like, generally designated 10, and comprising a buoyant body 11 which is preferably in the form of the leaf or leaves of a water lily, or similar aquatic plant. The buoyant body 11 is provided with a plurality of rings 12, one of which is shown in FIG. 1. On the upper surface of the buoyant body 11 there is an object 13, which simulates a frog, and more particularly, simulates a frog resting upon a water lily or water lily pad. As shown in FIG. 2, the frog-simulating object 13 is provided with a post **13*a* extending from the bottom thereof, and, as shown in FIG. 1, into a socket 13*b* formed in the upper surface of the buoyant body 11**.

A non-buoyant body **15*a* is connected with the buoyant body 11 by a pair of flexible strands 16*a* and 16*b*. The flexible strands 16*a* and 16*b* are preferably of monofilament and are therefore substantially invisible. The upper ends of the strands 16*a* and 16*b* are secured to the body 11 by being passed through spaced rings 12 (see also FIG. 2), the lower ends passing through spaced rings 12 on body 15*a* is shown in FIG. 1. There may also be provided a similar non-buoyant body 15*b*, also simulating a fish, and similarly supported by a pair of strands 16*c* and 16*d* which are secured at their lower ends to spaced apart rings 12 on the body 15*b*. At their upper ends, the strands 16*c* and 16*d* are connected, as shown in FIG. 2, to other rings 12 on the buoyant body 11**.

Also connected to the body 11 are a plurality of relatively small non-buoyant bodies 17*a*, 17*b* and 17*c*, each of which simulates a fish. Connecting each of the bodies 17*a*, 17*b* and 17*c* to the buoyant body 11 is a post 18, which extends upwardly and enters into a corresponding socket 18*a* provided in the lower surface of the buoyant body 11.

An anchor 21 of any suitable construction is provided, and is connected by a line or strand 22 to the buoyant body 11, so as to hold it in one area of the swimming pool in which it is positioned.

Shown in FIG. 1 on the buoyant body 11 is a simulation 30 of the bloom of a water lily, within which is a candle 40. Candle 40 includes wax 41 and a wick 42 within a glass 43.

Figure 3:
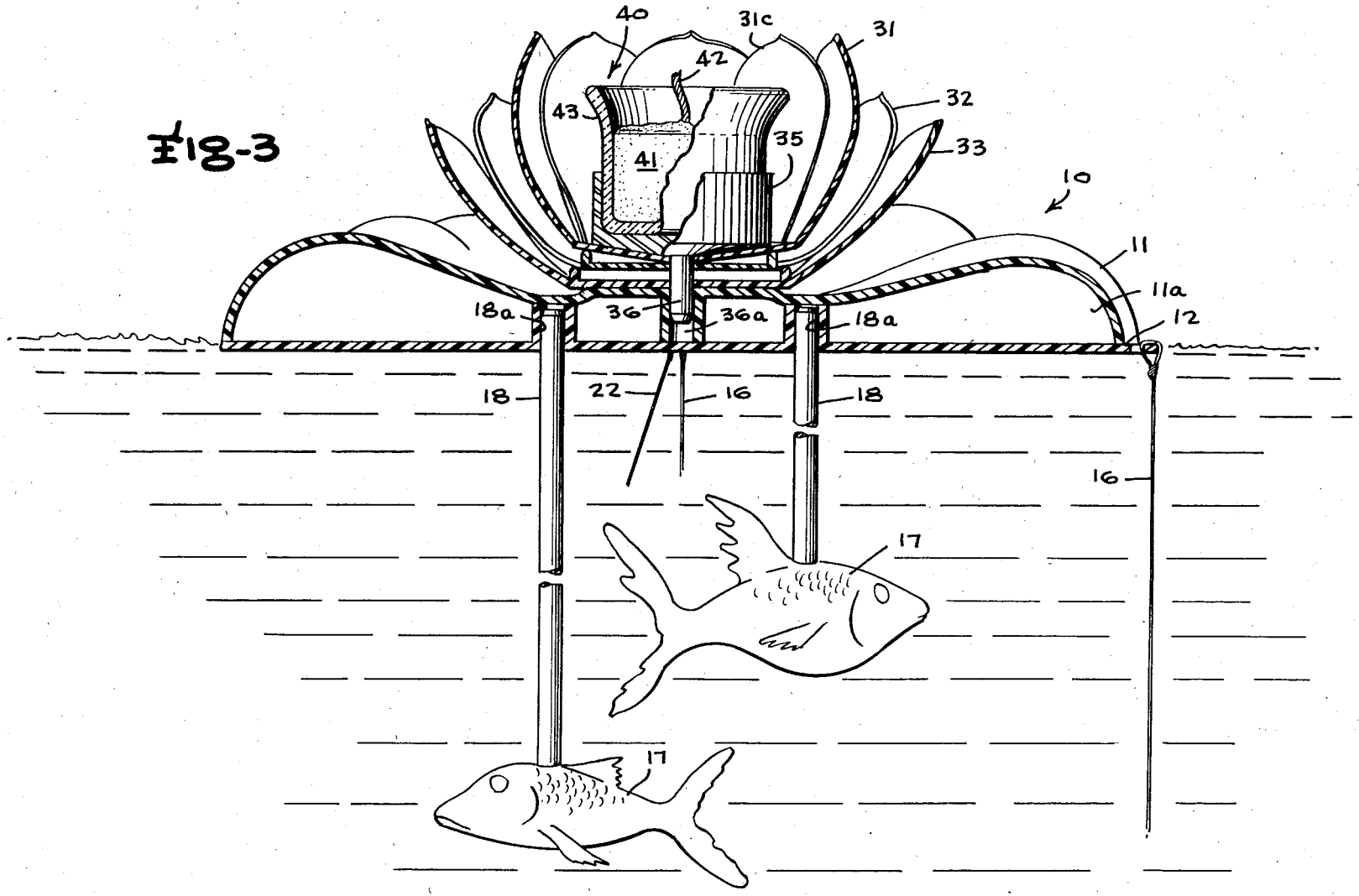
FIG. 3 is a cross-sectional view taken on the line 3—3 of FIG. 1.

The bloom-simulating structure 30 is shown in FIGS. 2 and 3 as including a plurality of petal-simulating elements 31, 32, and 33, each including a generally disc shaped central portion 31*a*, 32*a* and 33*a*, in the center part of which is an opening 31*b*, 32*b* and 33*b*. Extending upwardly from each of the disc portions 31*a*, 32*a*, and 33*a* are individual petal-simulating portions 31*c*, 32*c* and 33*c*. A cup 35 is provided, having a depending stem 36, cup 35 having therein the glass 43, within which are the wax 41 and wick 42.

Referring now to FIG. 3, there may be seen the ornamental floating apparatus 10, including the buoyant body 11. Preferably, buoyant body 11 is a hollow, plastic molded body having a sealed flotation chamber 11*a* therewithin. Sockets 18*a* are provided for the post 18 for supporting the fish-simulating bodies 17, there also being shown the ring 12 and a flexible strand 16.

In the upper surface of the body 11 there is shown a socket 36*a* for receiving the stem 36 which is shown depending from the bottom of the cup 35. The cup 35 is within the petal-simulating elements 31, 32 and 33, and more particularly the cup 35 is on the uppermost element 31, the glass 43 of candle 40 extending to a level below the upper portions of the petal-simulating portion 31*c* of petal-simulating element 31. The stem 36 extends through the aligned holes or openings 31*b*, 32*b* and 33*b* in the petal-simulating elements 31, 32 and 33, and into the socket 36*a*, thereby releasably securing the petal-simulating elements together, and to the body 11.

When placed in a body of water, such as a swimming pool, the ornamental floating apparatus 10 is preferably secured in one location or area by the anchor 21 and line 22. The fish-simulating bodies 15 and 17 are nonbuoyant, having either a negative or neutral buoyancy, and are connected to and supported in position by either the flexible connecting strands 16*a*–16*d*, or by the substantially rigid posts 18. When there is agitation of the water, such as ripples or waves at the surface portion of the swimming pool, the buoyant body 11 will be caused to rotate about a horizontal axis. More particularly, it will have an oscillating motion as successive ripples or waves strike it. Due to the rigid connection provided by the post 18, the bodies 17*a*, etc., will also rotate, i.e., oscillate, about a substantially horizontal axis. In addition, the bodies 15*a* and 15*b* will also rotate (oscillate) about a horizontal axis, when buoyant body 11 so rotates (oscillates), due to the fact that each of the bodies 15*a* and 15*b* is connected to the buoyant body 11 by two spaced apart flexible strands, the upper ends and the lower ends of which are connected to the body 11 and body 15, respectively, in spaced apart relationship. These constructions, therefore, provide for stability and enhanced visual and ornamental appeal.

Further, the various petal-simulating elements 31, 32 and 33 may be provided in selected colors, thereby enabling the ready intermixing and/or changing of colors and hues of the petal-simulating elements.

It will be obvious to one skilled in the art that various changes may be made without departure from the spirit of the invention, and therefore the invention is not limited to that shown in the drawings, and described in the specification but only as indicated in the appended claims.

I claim:

1. An ornamental floating apparatus comprising:

(a) a first body buoyant in water and configured to have rotational movement about a horizontal axis when struck by ripples, (b) at least one second body non-buoyant in water, and (c) connecting means extending downwardly from said first body (i) for supporting said second body from said first body when said first and second bodies are in water and (ii) for causing rotational movement of said second body about a horizontal axis upon rotational movement of said first body about a horizontal axis.

2. The ornamental floating apparatus of claim 1, said connecting means comprising a substantially rigid post.

3. The ornamental floating apparatus of claim 2, said first body having an opening in the bottom thereof, said post extending into said opening.

4. The ornamental floating apparatus of claim 2, said first body having in the bottom thereof a downwardly opening socket, said post extending into and engaging said socket.

5. The ornamental floating apparatus of claim 1, said connecting means comprising at least two flexible strands.

6. The ornamental floating apparatus of claim 5, wherein each said strand has an upper end and a lower end, said upper ends of said strands being connected to said first body in spaced apart relationship, and the lower ends of said strands being connected to said second body in spaced apart relationship.

7. The ornamental floating apparatus of claim 6, said first body having rings thereon, said strands engaged in said rings.

8. The ornamental floating apparatus of claim 1, wherein said connecting means comprises flexible strands, said apparatus further comprising at least one non-buoyant third body, connecting means extending downwardly from said first body for supporting said third body from said first body for rotational movement of said third body about a horizontal axis upon rotational movement of said first body about a horizontal axis, said lastmentioned connecting means comprising a substantially rigid post.

9. The ornamental floating apparatus of claim 8, said third body being substantially smaller than said second body.

10. The ornamental floating apparatus of claim 1, wherein said first body comprises means simulating a natural floral object.

11. The ornamental floating apparatus of claim 10, wherein said lastmentioned means comprises means for simulating a water lily.

12. The ornamental floating apparatus of claim 10, and further comprising means on said first body for holding a candle.

13. The ornamental floating apparatus of claim 12, said lastmentioned means being located in said central portion of said means for simulating a natural floral object.

14. The ornamental floating apparatus of claim 10, and further comprising means for simulating an animal on said first body.

15. The ornamental floating apparatus of claim 14, said lastmentioned means comprising means for simulating a frog.

16. The ornamental floating apparatus of claim 1, and an anchor connected to said first body.

17. A floating swimming pool ornament comprising:

(a) a buoyant support body, (b) a plurality of superimposed, substantially concentric petal-simulating elements on said body, each of said elements including a generally disc shaped central portion, (c) a cup on the uppermost of said petal-simulating elements, and (d) means for releasably securing said cup, petal-simulating elements and said body in assembled relationship.

18. The floating swimming pool ornament of claim 17, wherein said body and said petal-simulating elements have central holes therein, said holes being in aligned relationship, said securing means comprising a stem extending downwardly from said cup through said openings.

19. The floating swimming pool ornament of claim 18, said body having a socket in the upper portion thereof, said stem extending into and engaging such socket.

20. The floating swimming pool ornament of claim 17, said petal-simulating elements being of selected colors.

* * * * *